US008647090B2

(12) United States Patent
Jo et al.

(10) Patent No.: US 8,647,090 B2
(45) Date of Patent: Feb. 11, 2014

(54) INJECTION NOZZLE FOR ELECTROSPINNING AND ELECTROSPINNING DEVICE USING THE SAME

(75) Inventors: Byunggwang Jo, Gyeonggi-do (KR); Inyong Seo, Seoul (KR); Sangchul Suh, Seoul (KR); Chan Kim, Gwangju (KR); Cheolhyeon Kim, Seoul (KR); Seunghoon Lee, Gyeonggi-do (KR); Jaehwan Kim, Gyeonggi-do (KR)

(73) Assignee: Amogreentech Co., Ltd., Gyeonggi-Do (KR)

( * ) Notice: Subject to any disclaimer, the term of this patent is extended or adjusted under 35 U.S.C. 154(b) by 132 days.

(21) Appl. No.: 13/376,682

(22) PCT Filed: Jun. 11, 2010

(86) PCT No.: PCT/KR2010/003777

§ 371 (c)(1), (2), (4) Date: Dec. 7, 2011

(87) PCT Pub. No.: WO2010/143914

PCT Pub. Date: Dec. 16, 2010

(65) Prior Publication Data

US 2012/0082744 A1 Apr. 5, 2012

(30) Foreign Application Priority Data

Jun. 12, 2009 (KR) ..... 10-2009-0052113

(51) Int. Cl.
*D01D 5/098* (2006.01)

(52) U.S. Cl.
USPC ..... 425/66; 425/72.2; 425/83.1; 425/174.8 E

(58) Field of Classification Search
USPC ..... 425/66, 83.1, 174.8 E, 376.1, 461, 72.2
See application file for complete search history.

(56) References Cited

U.S. PATENT DOCUMENTS 4,781,560 A * 11/1988 Herbert ..... 425/133.5
5,476,616 A * 12/1995 Schwarz ..... 264/6

(Continued)

FOREIGN PATENT DOCUMENTS

EP 0 744 485 A1 11/1996
KR 200431592 11/2006

(Continued)

OTHER PUBLICATIONS

10786397 Srch. Rpt., Oct. 5, 2012, Search Report.

*Primary Examiner* — Yogendra Gupta
*Assistant Examiner* — Joseph Leyson
(74) *Attorney, Agent, or Firm* — Wells St. John PS

(57) ABSTRACT

An injection nozzle for electrospinning including a first nozzle body and a second nozzle body detachably coupled with each other and nozzle members inserted in the first and second nozzle bodies and an electrospinning device using the nozzle. The electrospinning device basically performs air electrospinning wherein a source liquid for fiber is injected together with air while the source liquid for fiber is discharged through the nozzle members, and pure electrospinning without air injection can be efficiently carried out by separating the second nozzle body in such a manner that the lower ends of the nozzle members are exposed for a predetermined length or more. Therefore, according to the present invention, pure electrospinning, air electrospinning or hot air electrospinning may be selectively carried out.

8 Claims, 2 Drawing Sheets

(56) References Cited

U.S. PATENT DOCUMENTS

| | | | | |
|---|---|---|---|---|
| 5,765,761 | A | 6/1998 | Law et al. | |
| 6,200,120 | B1 * | 3/2001 | Fish et al. | 425/83.1 |
| 6,336,801 | B1 | 1/2002 | Fish et al. | |
| 7,351,052 | B2 * | 4/2008 | Chun et al. | 425/174.8 R |
| 7,637,730 | B2 * | 12/2009 | Herda | 425/131.5 |
| 2002/0089094 | A1 * | 7/2002 | Kleinmeyer et al. | 264/465 |
| 2006/0049542 | A1 | 3/2006 | Chu et al. | |
| 2007/0200723 | A1 * | 8/2007 | Newberg | 340/686.4 |

FOREIGN PATENT DOCUMENTS

| | | |
|---|---|---|
| KR | 1020080099366 | 11/2008 |
| KR | 10-0874982 B1 | 12/2008 |
| KR | 100874982 | 12/2008 |
| KR | 1020080111849 | 12/2008 |

* cited by examiner

INJECTION NOZZLE FOR ELECTROSPINNING AND ELECTROSPINNING DEVICE USING THE SAME

CROSS REFERENCE TO RELATED APPLICATION

This is a 35 U.S.C. §371 application of, and claims priority to, International Application No. PCT/KR2010/003777, which was filed on Jun. 11, 2010 and published as Publication No. WO 2010/143914 A2, which claims priority to Korean Patent Application No. 10-2009-0052113, which was filed on Jun. 12, 2009, the entirety of all applications are incorporated herein by reference.

TECHNICAL FIELD

The present invention relates generally to an injection nozzle for electrospinning and an electrospinning device using the nozzle and, more particularly, to a technique invented to selectively carry out pure electrospinning, air electrospinning or hot air electrospinning.

BACKGROUND ART

Generally, electrospinning is used to produce a fine diameter fiber by extruding a source liquid for fiber charged with a voltage.

Electrospinning traces its roots to electrostatic spraying, in which when a water droplet forming on the tip of a capillary tube because of the water surface tension is charged with a high voltage, a fine diameter filament erupts from the surface of the droplet.

Electrospinning is based on the phenomenon wherein when an electrostatic force is applied to a polymer solution or a polymer melt having a sufficiently high viscosity, the solution or the melt forms a fiber. Because the electrospinning can produce fine diameter fibers from a source liquid for fiber, electrospinning is in recent years being used to produce nanofibers the diameters of which are on the scale of from several nanometers to several hundred nanometers.

Compared to conventional superfine fibers, nanofibers intrinsically have a high surface to volume ratio and a variety of surface and structural characteristics and, accordingly, the nanofibers are used as essential materials for high-technology industries, such as the electrical, electronic, environmental and biotechnology industries, and the application of the nanofibers is expanding to include their use as filters in the environmental industry, materials for the electrical and electronic industries, medical biomaterials, etc.

Nanofibers are typically produced using an electrospinning injection nozzle which extrudes a source liquid for fiber using air.

The electrospinning injection nozzle includes: a source liquid extruding unit that is formed in a spinneret body and extrudes the source liquid for fiber; and an air nozzle unit formed around the source liquid extruding unit in the spinneret body and having an air injection hole extending downwards from the periphery of the source liquid extruding unit, wherein the source liquid for fiber extruded from the source liquid to extruding unit is injected together with compressed air that has been fed downwards from the periphery of the source liquid extruding unit through the air injection hole.

An electrospinning device also includes a collector that collects the fiber drawn from the electrospinning injection nozzle.

In an electrospinning device, the electrospinning injection nozzle is connected to the positive pole and the collector is connected to the negative pole so that a voltage difference is created between the nozzle and the collector which renders electrospinning possible.

The electrospinning nozzle can produce nanofibers that have a diameter on the scale of from several nanometers to several hundred nanometers by injecting the source liquid for fiber together with the compressed air.

In the conventional electrospinning nozzle, to realize effective injection, the end of the source liquid extruding unit is recessed into the air injection hole.

However, when the conventional electrospinning nozzle is used to carry out general electrospinning in which only the source liquid for fiber is injected, the fiber formed by injecting the source liquid for fiber may be caught by the air injection hole and may clog the air injection hole. Accordingly, the conventional electrospinning nozzle is problematic in that its issue is limited to producing only nanofibers with diameters ranging from several to several hundred nanometers by injecting high-compressed air.

Further, another electrospinning nozzle in which the end of the source liquid extruding unit protrudes outside the air injection hole has been proposed.

However, in this electrospinning nozzle, to realize error-free electrospinning, the protruding length of the source liquid extruding unit is limited to 1~3 mm. Due to the limited protruding length, this electrospinning nozzle cannot carry out pure electrospinning in which only the source liquid for fiber is injected without injecting air.

In other words, in the related art, a pure electrospinning nozzle that carries out to pure electrospinning by injecting only the source liquid for fiber and an air electrospinning nozzle that carries out air electrospinning by feeding air have been separately produced and separately used.

Therefore, when the electrospinning device is used to produce a product having a variety of structural layers made of different diameter fibers using both the pure electrospinning nozzle carrying out the pure electrospinning by injecting only the source liquid for fiber and the electrospinning nozzle that carries out air electrospinning by feeding air, it is necessary to separately use the two types of electrospinning nozzles and this increases the facility cost and requires the nozzle to be frequently changed between the two types of electrospinning nozzles during an electrospinning process.

Furthermore, in the conventional electrospinning nozzle, an electrode is directly connected to the spinneret body and allows an electric current to flow in the source liquid for fiber fed into the source liquid extruding unit, so that the magnetic field may leak from the spinneret body to the outside. Accordingly, the conventional electrospinning nozzle is problematic in that the nozzle may not carry out stable or effective electrospinning and it is required to apply a high voltage so as to compensate for the leakage of the magnetic field.

Another problem of the conventional electrospinning nozzle resides in that to realize a direct connection of the electrode, it is required to use a metal material which is a conductive material to make the nozzle, and accordingly the nozzle is heavy and the production cost thereof is increased.

DISCLOSURE

Technical Problem

Accordingly, the present invention has been made keeping in mind the above problems occurring in the prior art, and an object of the present invention is to provide an electrospinning injection nozzle and an electrospinning device using the nozzle, which can form to nanofibers having fine diameters and which can selectively carry out either general electrospinning (Pure Electrospinning) in which only a source liquid for fiber is injected, air electrospinning in which the source liquid for fiber is injected together with high-compressed air or hot air electrospinning in which the source liquid for fiber is injected together with high-compressed hot air.

Technical Solution

In order to accomplish the above object, the present invention provides an injection nozzle for electrospinning including: a first nozzle body having a source liquid feed passage for receiving a source liquid for fiber fed from an outside;

a nozzle member provided to protrude downwards from a lower end of the first nozzle body and discharging downwards the source liquid for fiber fed through the source liquid feed passage; and a second nozzle body detachably mounted to the lower side of the first nozzle body, wherein the second nozzle body receives the nozzle member therein and is provided therein with an insert hole into which the nozzle member is inserted, with an injection hole being formed at a location below the insert hole so as to receive a lower part of the nozzle member therein, and with an air passage being formed in the second nozzle body so as to feed air to the injection hole.

Furthermore, the present invention provides an electrospinning device, including: a first nozzle body having a source liquid feed passage for receiving a source liquid for fiber fed from an outside;

a nozzle member provided to protrude downwards from a lower end of the first nozzle body and discharging downwards the source liquid for fiber fed through the source liquid feed passage;

a second nozzle body detachably mounted to the lower side of the first nozzle body, the second nozzle body receiving the nozzle member therein and being provided therein with an insert hole into which the nozzle member is inserted, with an injection hole being formed at a location below the insert hole so as to receive a lower part of the nozzle member therein, and with an air passage being formed in the second nozzle body so as to feed air into the injection hole;

a voltage applying unit connected to the source liquid feed passage of the first nozzle body and temporarily storing the source liquid for fiber therein and applying a voltage to the source liquid for fiber stored therein;

a source liquid supply unit from which the source liquid for fiber is supplied to the voltage applying unit;

an air supply unit from which air is supplied to the air passage; and a collector for collecting a web of fiber spun from the nozzle member.

Advantageous Effects

As described above, the present invention can selectively carry out either general electrospinning (Pure Electrospinning), air electrospinning or hot air electrospinning, thereby freely controlling the spinning style according to both the nanoweb structure and the type of products.

Further, the present invention is advantageous in that different spinning styles may be selectively used in a one-line process, so that the invention can be used to produce a product in which a variety of structural layers are laminated.

Further, the present invention is advantageous in that a voltage is applied to the source liquid for fiber, so that error-free electrospinning can be carried out using a low voltage.

BEST MODE

Figure 1:
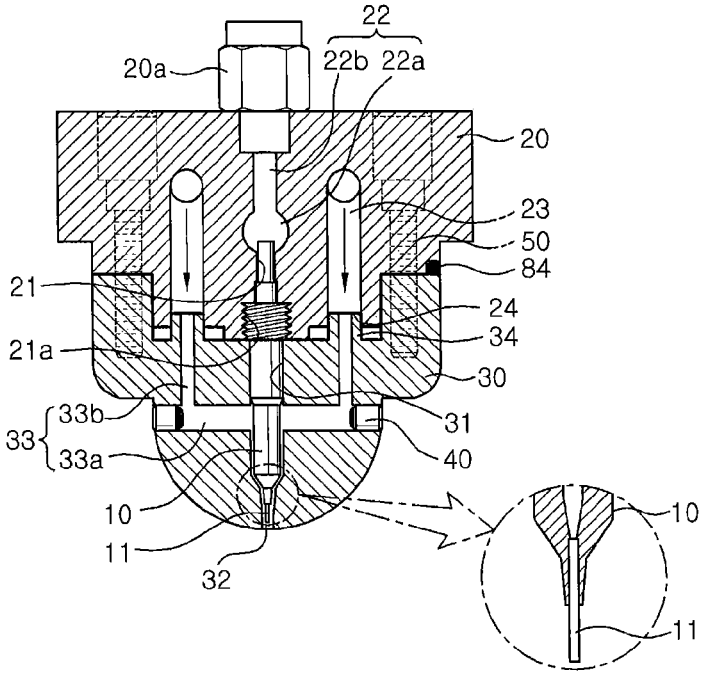
FIG. 1 and FIG. 2 are sectional views of an electrospinning injection nozzle according to the present invention.

As shown in FIG. 1, an axial passage is formed through a nozzle member 10 of the present invention so that a source liquid for fiber can be discharged through the axial passage into a needle member 11 mounted to the lower end of the nozzle member.

The needle member 11 is provided with a fine diameter through hole, the diameter of which is smaller than that of the axial passage, which communicates with the axial passage. The needle member 11 is inserted into an injection hole 32 of a second nozzle body 30 which will be described later. Further, this needle member 11 is installed in the injection hole 32 in such a way that the tip of the needle member is recessed relative to the injection hole 32.

The needle member 11 may be detachably mounted to the end of the nozzle member 10 so that the needle member can be replaced with a new one when it is damaged or broken.

Because the diameter of the needle member 11 is narrow, the needle member may be easily bent and deformed or broken by shock, so that it is preferable for the needle member to be configured so that it can be easily and simply replaced by a new one when the needle member is damaged or broken.

The needle member 11 is detachably mounted to the end of the nozzle member 10 by a screw type locking method. The method of detachably mounting the needle member to the nozzle member may be selected from a variety of conventional methods.

The needle member 11 is made of a conductive material capable of realizing effective electrospinning.

The nozzle member 10 is mounted to the lower part of a first nozzle body 20 and protrudes downwards from the lower end of the first nozzle body 20. The protruding part of the nozzle member 10 is inserted into the second nozzle body 30. The second nozzle body 30 is detachably mounted to the first nozzle body 20.

In the lower part of the first nozzle body 20, a nozzle locking part 21, into which the upper part of the nozzle member 10 is inserted and locked thereto, is formed.

In the nozzle locking part 21, a screw-type locking part 21*a*, to which the nozzle member 10 is mounted by a screw-type locking method, is provided, so that the nozzle member 10 can be detachably mounted to the nozzle locking part by means of the screw-type locking part 21*a*.

In the first nozzle body 20, a source liquid feed passage 22 for feeding the source liquid for fiber into the nozzle member 10, that is, into the axial passage of the nozzle member and a first air passage 23 extending to the lower surface of the first nozzle body and communicating with a second air passage 33 which will be described later herein, are formed.

Further, in the lower part of the first nozzle body 20, a plurality of nozzle locking parts 21 may be formed in such a way that they are arranged in single file and are spaced apart from each other so that a plurality of nozzle members 10 can be inserted into and mounted to the respective nozzle locking parts.

The source liquid feed passage 22 includes a plurality of main feed passages 22*a* which communicate with the axial passages of the plurality of nozzle members 10 inserted into the plurality of nozzle locking parts 21, and a plurality of connection feed passages 22*b* which communicate with the plurality of main feed passages 22*a*.

To the connection feed passages 22*b*, respective first pipe couplings 20*a* connected to a source liquid supply unit 70 which will be described later herein are mounted. The first pipe couplings 20*a* feed the source liquid for fiber from the source liquid supply unit into the main feed passages 22*a*.

Further, the plurality of nozzle members 10 may be mounted in such a way that the upper ends thereof protrude for a predetermined distance into the source liquid feed passage 22 or into the main feed passages 22*a*.

Here, the nozzle members 10 are mounted to the nozzle locking parts 21 by using a nozzle mounting jig (not shown) capable of holding the nozzle members 10 in such a way that the upper ends of the nozzle members protrude for a predetermined distance into the main feed passages 22*a*.

When the nozzle mounting jig is used to mount the nozzle members 10 by fitting, the holding part of the jig that holds the nozzle members 10 is caught by the lower part of the first nozzle body 20 and the upper ends of the nozzle members 10 protrude into the main feed passages 22*a* to the predetermined length.

Here, the length that the nozzle members 10 protrude for may be changed depending on the viscosity of the source liquid for fiber and, in the present invention, the protruding length of the nozzle members may be set to 3~5 mm or less.

When the nozzle members 10 unevenly protrude into the source liquid feed passage 22, the source liquid for fiber fed through the connection feed passages 22*b* is sequentially injected through the nozzle members 10 in order of the lengths they protrude by, from short to long.

Therefore, deviations may undesirably remain in the fiber layer which has been electrospun from the plurality of nozzle members 10 and collected on a collector.

When the upper ends of the nozzle members 10 are mounted in such a way that the upper ends are leveled with the bottom surfaces of the main feed passages 22*a*, the source liquid for fiber is fed to the nozzle members 10 in order of the extent by which the upper ends of the nozzle members approach the connection feed passages 22*b*, so that the source liquid for fiber cannot be synchronously electrospun from the plurality of nozzle members 10 and a deviation is formed in the electrospun and collected fiber layer.

However, when the source liquid for fiber is fed into the source liquid feed passage 22 in a state in which the upper ends of the nozzle members 10 protrude a predetermined distance into the main feed passages 22*a*, the source liquid for fiber gradually fills the main feed passages 22*a* from the bottom surfaces of the main feed passages 22*a* and is, thereafter, synchronously introduced into the plurality of nozzle members 10 at the height of the upper ends of the nozzle members 10 protruding from the bottom surfaces of the main feed passages 22*a*.

Therefore, the source liquid for fiber is synchronously injected and electrospun from the plurality of nozzle members 10, so that there is no deviation in the electrospun and collected fiber layer.

As described above, the second nozzle body 30 is detachably mounted to the lower side of the first nozzle body 20.

The second nozzle body 30 is detachably mounted to the lower side of the first nozzle body 20 and is provided in the upper surface thereof with insert holes 31 into which the respective nozzle members 10 are inserted.

At locations below the insert holes 31 in the second nozzle body, the injection holes 32 for injecting air from the lower ends of the nozzle members 10 or from the peripheries of the needle members 11 downwards are formed.

Here, the nozzle members 10 are placed in the injection holes 32 and air is injected via gaps defined between the injection holes and the nozzle members 10.

Further, the injection holes 32 receive air from the air passage and inject the air downwards from the gaps defined outside the peripheries of the needle members 11.

The air passage includes the first air passage 23 that is formed in the first nozzle body 20 and the second air passage 33 that is formed in the second nozzle body 30 and communicates both with the first air passage 23 and with the injection holes 32 and feeds air to the injection holes 32.

Further, the first air passage 23 extends to the upper surface of the first nozzle body 20, with a second pipe coupling (not shown) mounted to the upper end of the first air passage. The second pipe coupling is connected to an air supply unit 80 which will be described later herein.

When the first nozzle body 20 and the second nozzle body 30 are assembled with each other, the parts of the nozzle members 10 exposed outside the nozzle locking parts 21 are inserted into the respective insert holes 31. Here, the needle members 11 are placed in the injection holes 32 formed below the insert holes 31.

Here, the tips of the needle members 11 are recessed relative to the ends of the outlets of the injection holes 32.

Accordingly, the source liquid for fiber is discharged from the ends of the needle members 11 by the flow of air which flows quickly and is injected together with air strongly injected through the gaps defined inside the injection holes 32, so that no beads are formed.

Further, the air fed into the injection holes 32 is guided and concentrated to the ends of the axial holes of the needle members 11, so that the source liquid for fiber can be efficiently injected.

The second air passage 33 includes a first passage 33*a* which is horizontally formed through the second nozzle body 30 and communicates with the injection hole 32, and a second passage 33*b* which extends from the upper surface of the second nozzle body 30 to the first passage 33*a*.

The opposite open ends of the first passage 33*a* formed in the second nozzle body 30 are closed by respective plugs 40.

To form the second air passage 33, the second passage 33*b* is vertically formed from the upper surface of the second nozzle body so as to communicate with the first air passage 23, and the first passage 33*a* is horizontally formed between opposite sides of the second nozzle body 30 so as to communicate the second passage 33*b* with the injection hole 32. Therefore, the first passage 33*a* is open at the opposite sides of the second nozzle body 30.

The plugs 40 that close the opposite open ends of the first passage 33*a* as described above can prevent the air which, is fed into the injection hole 32 through both the first passage 33*a* and the second passage 33*b*, which constitute the second air passage 33, from leaking and can realize an efficient injection through the injection hole 32.

Further, on the upper surface of the second nozzle body 30, a plurality of bolt locking holes 52 are formed on each side in such a way that they are spaced apart from each other. Further, a plurality of bolt through holes corresponding to the bolt locking holes 52 are formed in the first nozzle body 20.

The first nozzle body 20 and the second nozzle body 30 are detachably assembled with each other using the plurality of locking bolts 50 that pass through the bolt through holes and are tightened to the bolt locking holes 52. The detachable assembly of the first and second nozzle bodies may be realized using a variety of conventional locking units in addition to the above-mentioned locking units.

In the lower surface of the first nozzle body 20 and in the upper surface of the second nozzle body 30, a locking part is provided. Due to the locking part, the first nozzle body and the second nozzle body can be locked to each other by a grooving and tonguing manner wherein the first air passage 23 and the second air passage 33 formed in the nozzle bodies communicate with each other.

The locking part includes a locking guide protrusion 34 which is formed on the upper surface of the second nozzle body 30, with the second air passage 33 being formed in the locking guide protrusion, and a locking hole 24 which is formed in the lower surface of the first nozzle body 20 so as to receive the locking guide protrusion 34 therein, with the first air passage 23 being formed in the locking hole.

The first nozzle body 20 and the second nozzle body 30 are assembled with each other by inserting the locking guide protrusion 34 into the locking hole 24 in such a way that the first air passage 23 and the second air passage 33 can be precisely aligned with each other and the junction between the first air passage 23 and the second air passage 33 can be sealed.

The locking guide protrusion 34 may be formed to protrude from the lower surface of the first nozzle body 20, with the first air passage 23 being formed in the locking guide protrusion, and the locking hole 24 may be formed in the upper surface of the second nozzle body 30, with the second air passage 33 being formed in the locking hole.

As described above, the locking guide protrusion 34 may be formed by protruding from either the lower surface of the first nozzle body 20 or the upper surface of the second nozzle body 30, and the locking hole 24 may be formed in a remaining one of the lower surface of the first nozzle body 20 and the upper surface of the second nozzle body 30.

The first nozzle body 20 and the second nozzle body 30 may be made of a synthetic resin material and may be made of any one of PEEK (Poly ether ether ketone), acetal (POM; Polyoxymethylene) and MC nylon (Mono Cast Nylon).

The PEEK (Poly ether ether ketone), acetal (POM; Polyoxymethylene) and MC nylon (Mono Cast Nylon) are engineering plastic materials that are excellent in terms of mechanical performance, such as heat resistance, chemical resistance and durability, so that it is possible to realize the desired strength of the cover body 20*b* or of the air jacket member 30 which are mounted in an assembled state. Of the above-mentioned materials, the PEEK which is a crystalline resin capable of being subjected to a dissolved molding process and has highest heat resistance is most preferable.

The first nozzle body 20 and the second nozzle body 30 are made of the PEEK (Poly ether ether ketone), acetal (POM; Polyoxymethylene) and MC nylon (Mono Cast Nylon), so that the nozzle bodies can carry out the hot air electrospinning in which the source liquid for fiber is injected using high-compressed hot air.

The hot air electrospinning can produce nanofibers having fine diameters.

In other words, in the electrospinning injection nozzle according to the present invention in which the second nozzle body 30 is mounted to the first nozzle body 20, the source liquid for fiber is fed to the nozzle members 10 and high-compressed air is fed to the injection holes 32, so that the source liquid for fiber can be injected together with air.

Here, the electrospinning injection nozzle according to the present invention can selectively carry out air electrospinning or hot air electrospinning capable of producing nanofibers having fine diameters.

Figure 2:
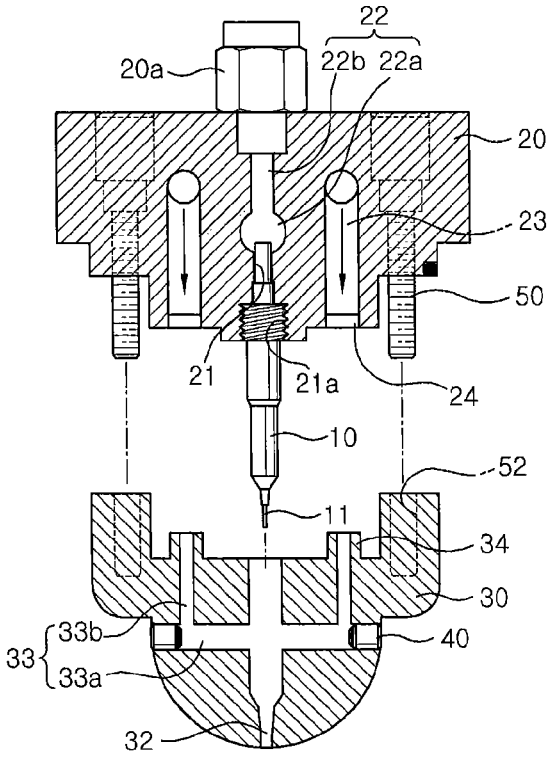

Further, as shown in FIG. 2, when the second nozzle body 30 is disassembled from the first nozzle body 20 in the electrospinning injection nozzle according to the present invention, the needle members 11 of the nozzle members 10 are exposed to the outside.

That is, the electrospinning injection nozzle according to the present invention can carry out pure electrospinning in which only the source liquid for fiber is injected from the needle members 11 without the injection of air.

When the tips of the needle members 11 are recessed into the injection holes 32 in a state in which the second nozzle body 30 is mounted to the first nozzle body 20, it is impossible to carry out electrospinning without injecting air.

When only the source liquid for fiber is injected without injecting air, the fiber formed by injecting the source liquid for fiber from the recessed tips of the needle members 11 may be caught by the injection holes 32 and may clog the injection holes, so that electrospinning may not be carried out efficiently.

Therefore, error-free pure electrospinning without injecting air can be realized by separating the second nozzle body 30 from the nozzle members 10 and thereby exposing the needle members 11 to the outside.

Figure 3:
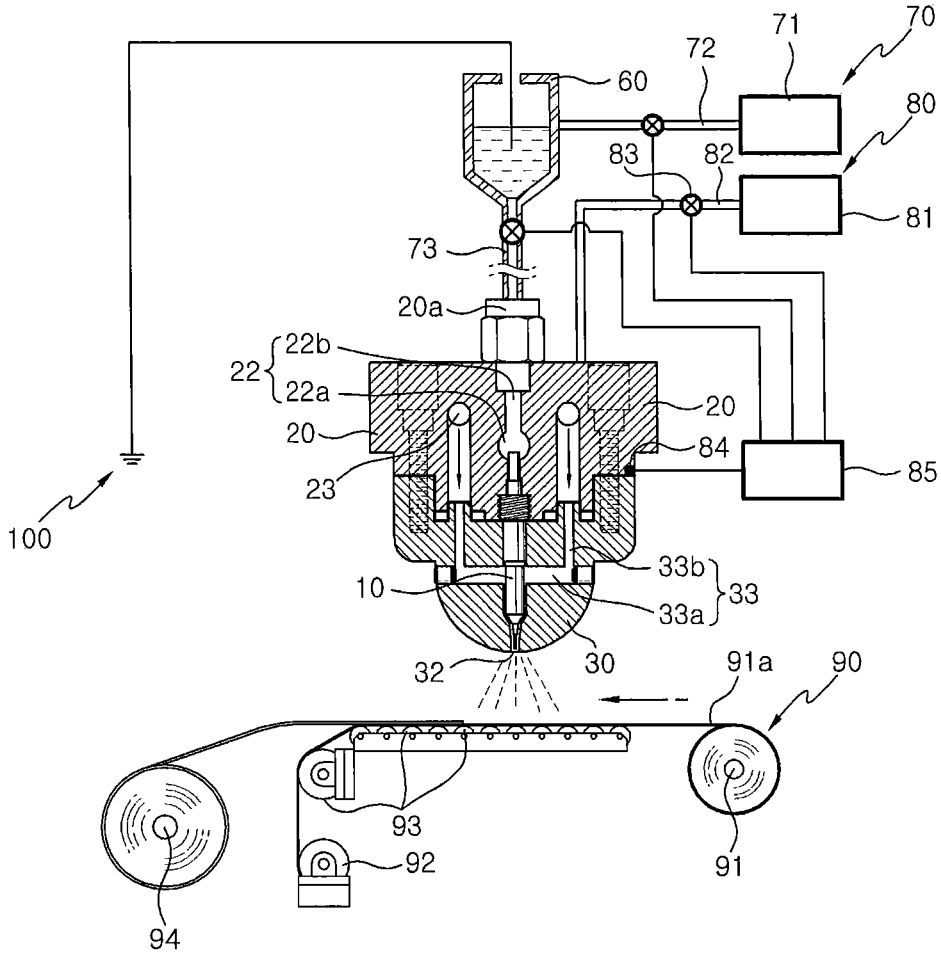
FIG. 3 is a schematic view illustrating an electrospinning device according to the present invention.

Further, as shown in FIG. 3, an electrospinning device using the above-mentioned electrospinning nozzle of the present invention includes: the first nozzle body 20 provided with the source liquid feed passage 22 for receiving the source liquid for fiber from the outside;

the nozzle members 10 mounted to the lower end of the first nozzle body 20 in such a way that the nozzle members 10 protrude downwards, the nozzle members receiving the source liquid for fiber from the source liquid feed passage 22 and discharging the source liquid for fiber downwards;

the second nozzle body 30 detachably mounted to the lower side of the first nozzle body 20 and provided therein with the insert holes 31, into which the nozzle members 10 are inserted, with the injection holes 32 being formed at locations below the insert holes so as to receive the lower parts of the nozzle members 10 therein, and with the air passage being formed in the second nozzle body so as to feed air to the injection holes 32;

a voltage applying unit 60 connected to the source liquid feed passage 22 of the first nozzle body 20 and temporarily storing the source liquid for fiber therein and applying a voltage to the source liquid for fiber stored therein;

the source liquid supply unit 70 for supplying the source liquid for fiber to the voltage applying unit 60;

the air supply unit 80 for supplying air to the air passage; and the collector 90 for collecting a web of fiber spun from the nozzle members 10.

The electrospinning device of the present invention further includes a voltage supply unit 100, in which one electrode for applying a voltage is connected to the source liquid for fiber stored in the voltage applying unit 60 and the other electrode is grounded, so that a voltage difference can be generated.

The source liquid supply unit 70 includes a source liquid storage tank 71 for storing the source liquid for fiber, a first hose 72 extending from the source liquid storage tank 71 to the voltage applying unit 60 and a second hose 73 extending from the voltage applying unit 60 to the source liquid feed passage 22. The source liquid supply unit 70 feeds the source liquid for fiber to the source liquid feed passage 22 through the voltage applying unit 60.

Further, it is preferred that a flow control valve for controlling the amount of supplied source liquid for fiber be mounted to the first hose 72 or to the second hose 73, thereby controlling the amount of source liquid for fiber supplied to the source liquid feed passage 22.

The second hose 73 is connected to the first pipe coupling 20*a* that is mounted to the source liquid feed passage 22 in the upper surface of the first nozzle body 20. The second hose 73 feeds the source liquid for fiber, in which an electric current flows, to the source liquid feed passage 22.

As described above, in the electrospinning device of the present invention, the source liquid for fiber fed from the source liquid storage tank 71 is temporarily stored in the voltage applying unit 60 and a voltage is applied to the stored source liquid for fiber.

In the voltage supply unit 100, one electrode is connected to the source liquid for fiber stored in the voltage applying unit 60 and the other electrode is grounded so that a voltage difference capable of realizing electrospinning can be generated between the nozzle members 10 and the collector 90 that collects the web of fiber electrospun from nozzle members 10.

The collector 90 includes: a first reel 91, around which is wound a fiber collecting sheet 91*a*, such as a vellum paper sheet, a nonwoven fabric sheet or a film sheet, in order to collect the electrospun fiber;

a second reel 92, which is placed at a location spaced apart from the first reel 91 and to which the end of the fiber collecting sheet 91*a* wound around the first reel 91 is connected and which is rotated by a motor takes up the fiber collecting sheet 91*a;* a plurality of guide rolls 93 placed between the first reel 91 and the second reel 92 in such a way that the guide rolls are spaced apart from each other by predetermined distances and guiding the movement of the fiber collecting sheet 91*a* fed from the first reel 91 to the second reel 92; and a third reel 94 placed at a location near the second reel 92 and rotated by a motor and taking up the electrospun fiber collected on the fiber collecting sheet.

In the present invention, electrospinning is realized by the application of voltage to the source liquid for fiber, so that the present invention can prevent the electrospinning from being variable or inefficient as may happen when the magnetic field leaks to the outside of both the first nozzle body 20 and the second nozzle body 30, and, furthermore, can realize error-free electrospinning even when the voltage difference between the needle members and the collector 90 is small.

Further, the fiber electrospun from the needle members 11 of the nozzle members 10 is collected in the form of a web on the surface of the fiber collecting sheet 91*a* and is moved together with the fiber collecting sheet 91*a*, and is taken up around the third reel 94.

Here, the fiber collecting sheet 91*a* taken up by the second reel 92 may be removed from the second reel and may be installed on the first reel 91 so as to be reused.

Further, the second nozzle body 30 can be assembled with or removed from the first nozzle body 20 so that the present invention can selectively carry out general electrospinning (pure electrospinning), air electrospinning or hot air electrospinning.

Further, the first nozzle body 20, the second nozzle body 30 and the nozzle members 10 included in the electrospinning device of the present invention remain the same as those described in the above description, so that the further explanation of the elements is omitted to avoid duplicating the explanation.

The air supply unit 80 includes: an air storage tank 81 storing air therein;

an air feed pipe 82 extending from the air storage tank 81 to the first air passage 23;

an air control valve 83 mounted to the air feed pipe 82 and opening or closing the air feed pipe 82;

a sensor 84 provided in the junction between the first nozzle body 20 and the second nozzle body 30 and sensing the locked or separated state of the second nozzle body 30; and a valve control unit 85 cooperating both with the sensor 84 and with the air control valve 83 and opening or closing the air control valve 83 in response to a signal output from the sensor 84.

The valve control unit 85 also cooperates with the flow control valves of both the first hose 72 and the second hose 73, thereby opening or closing the flow control valves and thereby controlling the opening ratios of the flow control valves.

Further, the sensor 84 uses a contact sensor, which is mounted to the lower surface of the first nozzle body 20 in such a way that the sensor comes into contact with the upper surface of the second nozzle body 30.

The sensor 84 basically functions to sense the locked or separated state of the second nozzle body 30 relative to the lower surface of the first nozzle body 20 and the sensor 84 may be variously modified using conventional sensors.

When a signal indicative of a separated state of the second nozzle body 30 is output from the sensor 84 to the valve control unit 85, the air control valve 83 closes the air feed pipe 82.

Accordingly, when the second nozzle body 30 is separated from the first nozzle body 20, air is not fed to the nozzle members, but only the source liquid for fiber is injected from the needle members 11, so that pure electrospinning can be carried out.

However, when the second nozzle body 30 is locked to the first nozzle body, the sensor 84 senses the locked state of the second nozzle body and outputs a signal indicative of the locked state to the valve control unit 85.

In response to the input signal, the valve control unit 85 actuates the air control valve 83 and opens the air feed pipe 82.

Therefore, when the second nozzle body 30 is locked to the first nozzle body 20, air or hot air is fed to the injection holes 32 and the source liquid for fiber is fed to the nozzle members 10 so that air electrospinning or hot air electrospinning can be carried out.

The electrospinning device of the present invention can control the supply of air by automatically sensing the locked or separated state of the second nozzle body 30, so that the present invention can selectively carry out error-free pure electrospinning or air electrospinning without having to additionally control the supply of air.

Although the preferred embodiments of the present invention have been disclosed for illustrative purposes, those skilled in the art will appreciate that various modifications, additions and substitutions may be made without departing from the scope and spirit of the invention as disclosed in the accompanying claims.

The invention claimed is:

1. An injection nozzle for electrospinning, comprising:

a first nozzle body having a source liquid feed passage for receiving a source liquid for fiber fed from an outside;

a nozzle member provided to protrude downwards from a lower end of the first nozzle body and discharging downwards the source liquid for fiber fed through the source liquid feed passage; and a second nozzle body detachably mounted to the lower side of the first nozzle body, wherein the second nozzle body receives the nozzle member therein and is provided therein with an insert hole into which the nozzle member is inserted, with an injection hole being formed at a location below the insert hole so as to receive a lower part of the nozzle member therein, and with an air passage being formed in the second nozzle body so as to feed air to the injection hole, wherein the air passage includes: a first air passage formed in the first nozzle body; and a second air passage formed in the second nozzle body so as to communicate both with the first air passage and with the injection hole and to feed air to the injection hole, and the second air passage includes: a first passage horizontally and thoroughly formed between opposite sides of the second nozzle body so as to communicate with the insert hole; and a second passage vertically formed from an upper surface of the second nozzle body so as to communicate with the first passage.

2. The injection nozzle for electrospinning as set forth in claim 1, further comprising:

a needle member detachably mounted to the lower side of the first nozzle body and placed in the injection hole.

3. The injection nozzle for electrospinning as set forth in claim 1, further comprising:

plugs mounted to opposite ends of the first passage, thereby closing open ends at which the first passage is open on the opposite sides of the second nozzle body.

4. The injection nozzle for electrospinning as set forth in claim 1, wherein in a lower surface of the first nozzle body and in an upper surface of the second nozzle body respectively having a first air passage and a second air passage, locking parts are provided to be assembled with each other in a grooving and tonguing manner so that the first and second air passages communicate with each other.

5. The injection nozzle for electrospinning as set forth in claim 1, wherein a plurality of nozzle locking parts for locking a plurality of nozzle members are formed in a lower part of the first nozzle body in such a way that the nozzle locking parts are spaced apart from each other, and the source liquid feed passage communicates with passages of the plurality of nozzle members locked to the plurality of the nozzle locking parts and includes a main feed passage for feeding the source liquid for fiber to the nozzle members, wherein the plurality of nozzle members are mounted in such a way that upper ends of the nozzle members protrude a predetermined distance into the main feed passage.

6. The injection nozzle for electrospinning as set forth in claim 1, wherein a sensor is provided between the first nozzle body and second nozzle body so as to sense a separated or locked state of the second nozzle body.

7. An electrospinning device, comprising:

a first nozzle body having a source liquid feed passage for receiving a source liquid for fiber fed from an outside;

a nozzle member provided to protrude downwards from a lower end of the first nozzle body and discharging downwards the source liquid for fiber fed through the source liquid feed passage;

a second nozzle body detachably mounted to the lower side of the first nozzle body, the second nozzle body receiving the nozzle member therein and being provided therein with an insert hole into which the nozzle member is inserted, with an injection hole being formed at a location below the insert hole so as to receive a lower part of the nozzle member therein, and with an air passage being formed in the second nozzle body so as to feed air into the injection hole;

a voltage applying unit connected to the source liquid feed passage of the first nozzle body and storing the source liquid for fiber therein and applying a voltage to the source liquid for fiber stored therein;

a source liquid supply unit from which the source liquid for fiber is supplied to the voltage applying unit;

an air supply unit from which air is supplied to the air passage; and a collector for collecting a web of fiber spun from the nozzle member, wherein:

the air passage includes: a first air passage formed in the first nozzle body; and a second air passage formed in the second nozzle body so as to communicate both with the first air passage and with the injection hole and to feed air to the injection hole, and the second air passage includes: a first passage horizontally and thoroughly formed between opposite sides of the second nozzle body so as to communicate with the insert hole; and a second passage vertically formed from an upper surface of the second nozzle body so as to communicate with the first passage.

8. The electrospinning device as set forth in claim 7, wherein the air supply unit includes: an air storage tank for storing air therein;

an air feed pipe extending from the air storage tank to the air passage;

an air control valve mounted to the air feed pipe and opening or closing the air feed pipe;

a sensor for sensing a locked or separated state of the second nozzle body relative to the first nozzle body; and a valve control unit cooperating both with the sensor and with the air control valve and opening or closing the air control valve in response to a signal output from the sensor.

* * * * *